US007409993B2

(12) United States Patent
Han et al.

(10) Patent No.: US 7,409,993 B2
(45) Date of Patent: Aug. 12, 2008

(54) WEIGHT SPACER APPARATUS

(75) Inventors: Chenghua Han, Sugar Land, TX (US); Bennie Gill, Fulshire, TX (US); Mark C. Duhon, Sugar Land, TX (US); Robert Ferrence, Sugar Land, TX (US); Jerry D. Campbell, Jr., Katy, TX (US); Ronald Lutz, Deer Park, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 58 days.

(21) Appl. No.: 11/561,641

(22) Filed: Nov. 20, 2006

(65) Prior Publication Data

US 2008/0053298 A1 Mar. 6, 2008

Related U.S. Application Data

(60) Provisional application No. 60/823,810, filed on Aug. 29, 2006.

(51) Int. Cl.
*E21B 43/117* (2006.01)

(52) U.S. Cl. ..... 166/297; 166/50; 166/55.1; 175/4.51

(58) Field of Classification Search ..... 175/4.51; 166/297, 55.1, 50
See application file for complete search history.

(56) References Cited

U.S. PATENT DOCUMENTS

| | | | | |
|---|---|---|---|---|
| 4,410,051 | A * | 10/1983 | Daniel et al. | 175/4.51 |
| 4,438,810 | A * | 3/1984 | Wilkinson | 166/66.5 |
| 5,211,714 | A * | 5/1993 | Jordan et al. | 166/297 |
| 5,964,294 | A * | 10/1999 | Edwards et al. | 166/297 |
| 6,305,475 | B1 | 10/2001 | Carnahan | |
| 7,000,699 | B2 | 2/2006 | Yang | |
| 7,114,564 | B2 | 10/2006 | Parrott | |
| 2002/0185275 | A1 * | 12/2002 | Yang et al. | 166/297 |
| 2003/0188867 | A1 | 10/2003 | Parrott et al. | |
| 2004/0149492 | A1 * | 8/2004 | Taylor et al. | 175/57 |

FOREIGN PATENT DOCUMENTS

| | | |
|---|---|---|
| GB | 2390623 A | 1/2004 |
| GB | 2390624 A | 1/2004 |
| GB | 2390627 A | 1/2004 |
| GB | 2401383 A | 11/2004 |
| WO | 0054009 | 9/2000 |

* cited by examiner

*Primary Examiner*—Hoang Dang
(74) *Attorney, Agent, or Firm*—Clarence E. Eriksen; Kevin B. McGoff; Bryan P. Galloway

(57) ABSTRACT

A weight spacer apparatus has a carrier which is tubular in shape and a spacer tube which is also tubular in shape for insertion into the carrier. The weight spacer apparatus also has a plurality of weight bars which may be inserted into the spacer tube after the spacer tube is inserted into the carrier and which are also removable from the spacer tube. In one embodiment, a weight tray is inserted into the spacer tube for receiving the weight bars, and the weight tray may be fabricated from half-round tubing with a welded plate to cover the diametric opening. In another embodiment, a center plate is attached inside the spacer tube along the length of the spacer tube to divide the spacer tube into first and second compartments.

15 Claims, 4 Drawing Sheets

WEIGHT SPACER APPARATUS

CROSS-REFERENCE TO RELATED APPLICATION

The present application claims the benefit of the filing date of Provisional Application No. 60/823,810, filed Aug. 29, 2006.

BACKGROUND OF THE INVENTION

1. Field of the Invention

The present invention generally relates to perforating apparatus, and, more particularly, to orienting apparatus for use in a perforating gun string.

2. Description of the Prior Art

For purposes of enhancing production from a subterranean formation, a perforating gun typically is lowered down into a wellbore that extends through the formation. A perforating gun may, for example, comprise a plurality of radially-oriented shaped charges which are detonated to form perforations in the formation proximate the wellbore. The shaped charges may, for example, be placed at points along a helical spiral that extends around a longitudinal axis of the perforating gun.

In certain applications of perforating guns, orientation apparatus is included in the perforating gun string to orient the string correctly. Orientation apparatus is, for example, commonly used in highly deviated or horizontal wells. The purpose of the orientation apparatus is to provide torque for correct orientation of the perforating string.

An internal swiveled gun is one type of orientation apparatus that has been utilized. In each perforating gun, the two ends of its loading tube are mounted with bearings. By special arrangement of the charges loaded in the tube and gravitational force, the correct orientation of the perforating gun can be realized. The drawbacks of such a design are it is expensive, it lacks reliability and it is difficult to operate.

Weight spacer assembly (WSA) is another way to realize the oriented perforating. WSA is an independent subassembly used together with a gun string and comprises a hollow carrier, a spacer tube having a weight tray and weight bars. The tray is made from a half round tube and partitioned into a small weight storage tray. Weight bars are placed inside the weight trays and permanently fastened inside the tray. Therefore, weight bars and the tray have to be handled as a whole at all times. The weight of the weight bar and tube is substantial with a 10 foot 7.00" WSA weight bar weighing up to 800 lbs. Handling of the weight spacer assembly thus imposes huge difficulties for manufacturing and operation (in assembling and disassembling).

For example, a crane or other lifting equipment must be used to effect the insertion of the spacer tube into the carrier. Because of the substantial weight of a loaded spacer tube, the spacer tube is subject to being bent or severely deformed during the handling. Yet another issue with this heavy loading tube arises once the spacer tube is successfully placed inside the carrier. Keys of the alignment plates in the spacer tube need to be placed in the keyways of the carrier. Because of the tight tolerances between the alignment plate, the carrier and the massive weight, it is an arduous task for the operators to complete this assembling step.

SUMMARY OF THE INVENTION

In accordance with the present invention, a weight spacer apparatus is provided which comprises a carrier which is tubular in shape and a spacer tube which is also tubular in shape for insertion into the carrier. A weight spacer apparatus according to the present invention further comprises a plurality of weight bars which may be inserted into the spacer tube after the spacer tube is inserted into the carrier and which are removable from the spacer tube.

In one embodiment of the present invention a weight tray may be fabricated from half-round tubing, with a welded plate to cover the diametric opening. The weight tray is inserted in the spacer tube, and once the spacer tube is inserted into the carrier, the weight bars may be inserted into the weight tray.

In another embodiment weight spacer apparatus according to the present invention comprises a center plate which is attached inside the spacer tube along the length of the spacer tube to divide the spacer tube in the first and second compartments. The first compartment of the divided spacer tube constitutes a weight tray for receiving the plurality of weight bars. In this embodiment, weight spacer apparatus according to the present invention has openings formed in the portion of the spacer tube opposite the first compartment for receiving shaped charges. These shaped charges are installed in each of the openings in the spacer tube, and a detonating cord is disposed in the spacer tube for connecting the shaped charges.

In accordance with the present invention, a perforating string is provided comprising at least one perforating gun section and a weight spacer, where the weight spacer comprises a carrier which is tubular in shape, a spacer tube which is tubular in shape and which is for insertion into the carrier and a plurality of weight bars which may be placed in the spacer after the spacer tube has been inserted into the carrier and which are removable from the spacer tube. The features of the weight bar apparatus in the perforating string are as described above.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 1:
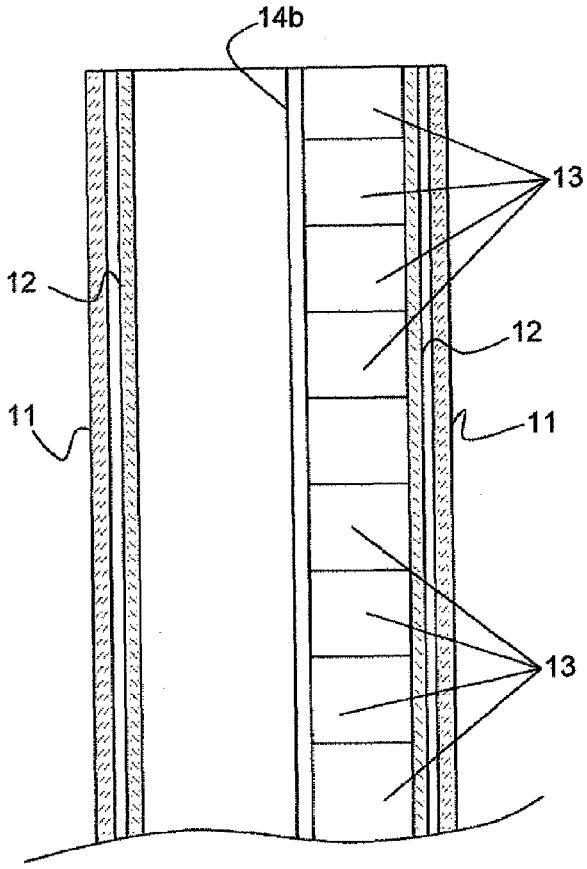
FIG. 1 is an elevation view in partial cross-section taken along the longitudinal axis of one embodiment of weight spacer apparatus of the present invention.

With reference first to FIG. 1, there is illustrated one embodiment of a weight spacer assembly 10 in accordance with the present invention. Weight spacer assembly 10 comprises a carrier 11 which is tubular in shape and a spacer tube 12 which is also tubular in shape and which is for insertion into the carrier 11. A plurality of weight bars 13 may be placed in the spacer tube 12 after the spacer tube is inserted in the carrier 11. In accordance with the present invention, these weight bars 13 are also removable from the spacer tube 12.

Figure 2:
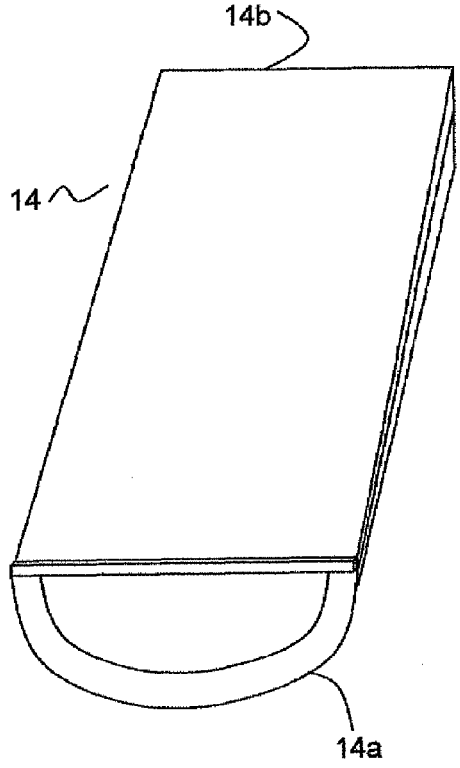
FIG. 2 is a perspective view of the weight tray 14 of FIG. 1.
Figure 3:
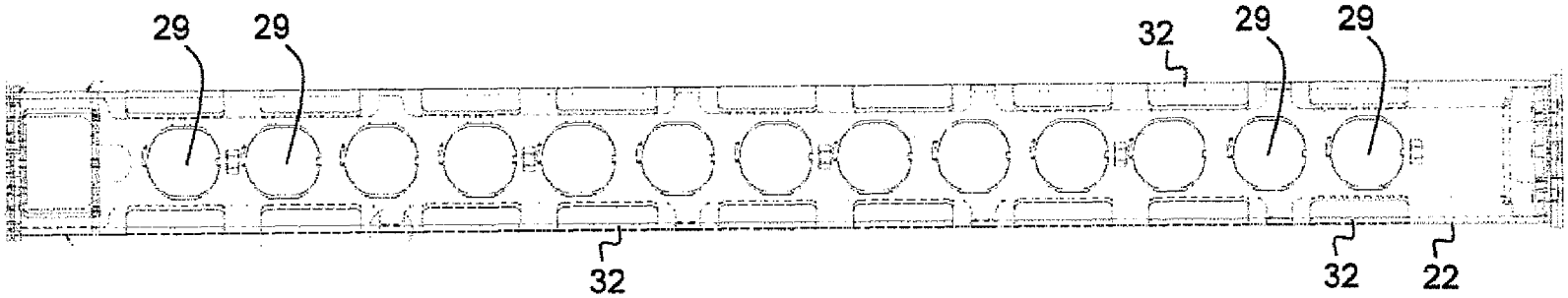
FIG. 3 is an elevation view in partial cross-section view taken along the longitudinal axis of a second embodiment of weight spacer apparatus according to the present invention.
Figure 4:
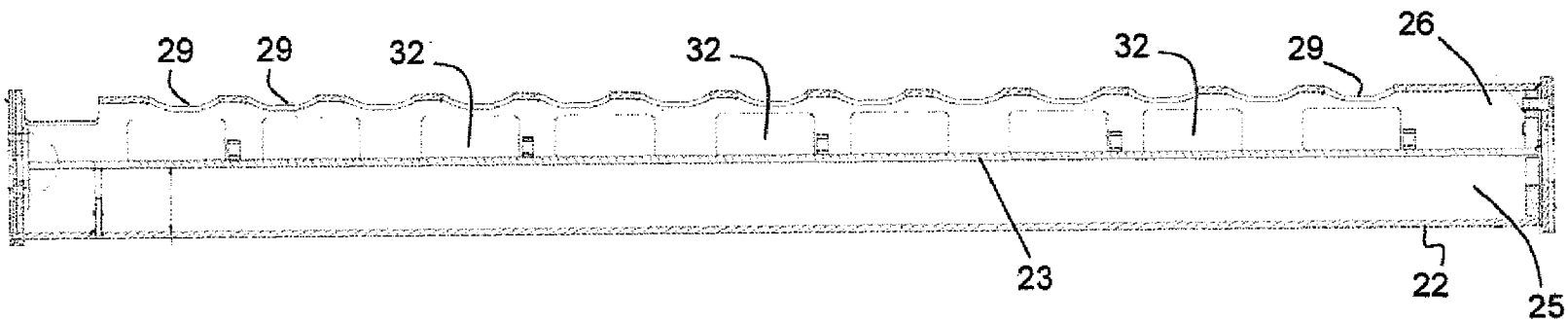
FIG. 4 is an elevation view in partial cross-section of the apparatus of FIG. 3 where the apparatus of FIG. 3 has been rotated 90°.
Figure 5:
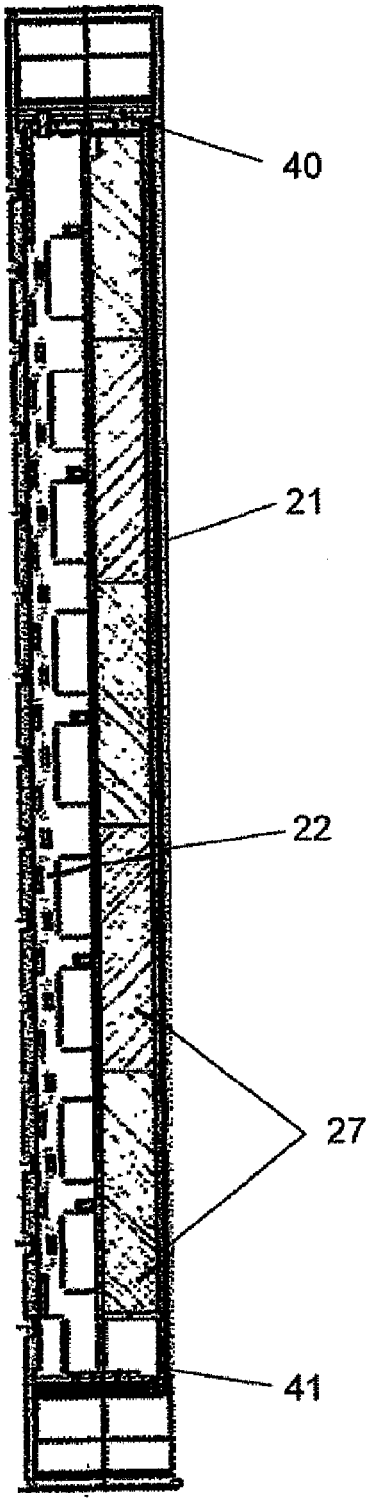
FIG. 5 is an elevation view in partial cross-section illustrating the embodiment of FIG. 4 loaded with weights.

With reference to FIGS. 1 and 2, the weight bars 13 may be placed in a weight tray 14 which is made from half-round tubing material 14*a* that has a welded plate 14*b* covering the diametric opening. One end of the weight tray 14 is permanently blocked by an end plate (not show). The other end of the weight tray 14 is open before the weight bars 13 are inserted into the weight tray and is blocked by a lower end plate (not shown) after the weight bars 13 are inserted.

With reference now to FIGS. 3-6, another embodiment of weight spacer apparatus 20 in accordance with the present invention is illustrated. Weight spacer apparatus 20 comprises a tubular carrier 21 and a tubular spacer tube 22, and the spacer tube 22 is for insertion into carrier 21. A center plate 23 is welded inside the spacer tube 22 and divides the spacer tube 22 into two compartments 25 and 26. Weight bars 27 may be placed in or removed from compartment 25 and compartment 25 thus provides the function of a weight tray. Upper and lower alignment plates 40 and 41 function to retain weight bars 27 in compartment 25.

Figure 6:
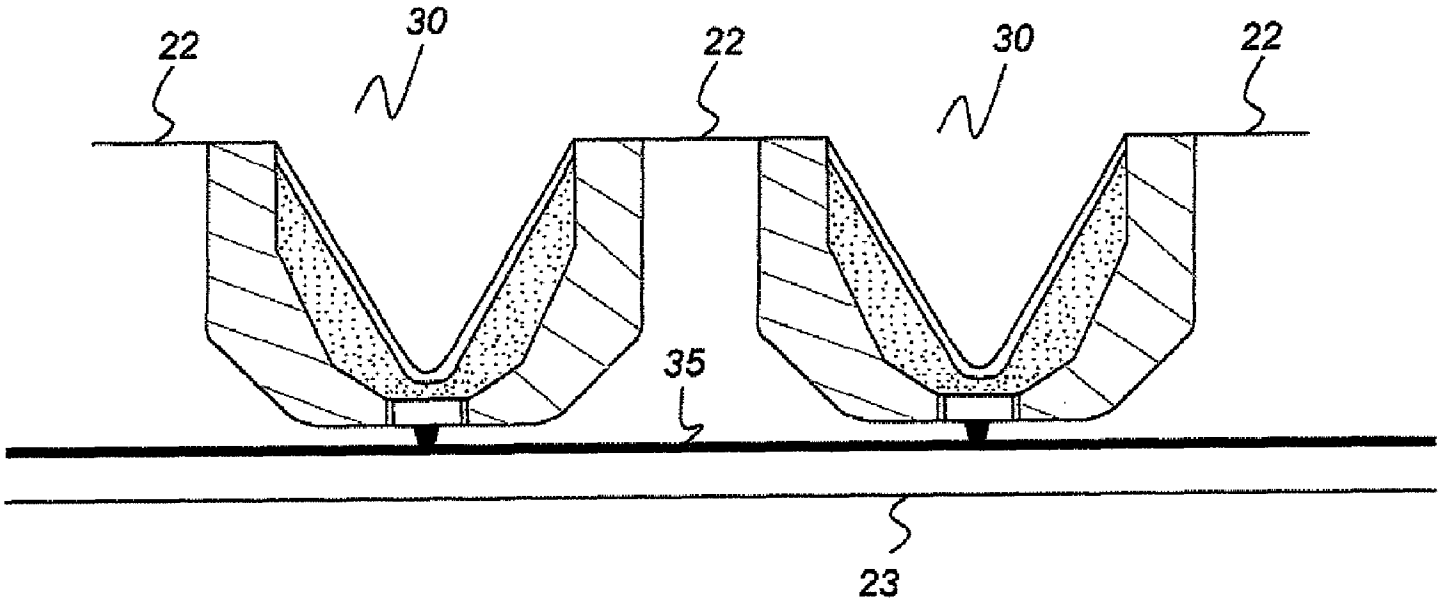
FIG. 6 is cross-sectional view of weight spacer apparatus of the present invention with shaped charges installed in the openings 29 shown in FIGS. 3 and 4.

Openings 29 may be formed in that portion of the spacer tube 22 which is opposite from compartment 25. These openings 29 are for receiving shaped charges 30, such as illustrated in FIG. 6. The structure and operation of shaped charge 30 is well-known to those skilled in the art. A detonating cord 35 runs from one end of the weight spacer apparatus 20 to the other end and is used to connect the plurality of shaped charges 30 that are installed in openings 29 into the ballistic train of a perforating string.

Still referring to FIGS. 3-6, a plurality of additional openings 32 may also be made in that portion of the spacer tube 22 which is opposite from compartment 25. These openings 32 are made to facilitate the installation of shaped charges 30 and to reduce the weight on that portion of the spacer tube opposite compartment 25 so that the requisite at torque may be achieved to orient the perforating string appropriately.

The embodiments of weight spacer apparatus 20 illustrated in FIGS. 3-6 permits the user to obtain a perforating capability that has not heretofore existed. For example, the weight spacer apparatus 20 provides an orienting apparatus with perforating capability, which thus increases the perforating capability of the perforating string in which it is utilized.

What is claimed is:

1. Weight spacer apparatus, comprising:

a carrier which is tubular in shape;

a spacer tube which is tubular in shape and which is located inside the carrier; and a plurality of weight bars located inside the spacer tube and which may be placed in the spacer tube after the spacer tube is inserted in the carrier and which are removable from the spacer tube;

wherein the spacer tube comprises a weight tray for receiving the weights, the weight tray comprising a half-round tubing material and a plate covering a diametric opening of the half-round tubing material, the half-round tubing material and the plate together forming a longitudinally extending enclosure having an opening at each end, and an end plate covering at least a portion of one of the openings.

2. Weight spacer apparatus, comprising:

a carrier which is tubular in shape;

a spacer tube which is tubular in shape and which is for insertion into the carrier; and a plurality of weight bars which maybe placed in the spacer tube after the spacer tube is inserted in the carrier and which are removable from the spacer tube;

wherein it further comprises a center plate which is attached inside the spacer tube along the length of the spacer tube to divide the spacer tube into first and second compartments.

3. The weight spacer apparatus of claim 2, wherein the first compartment of the divided spacer tube is for receiving the plurality of weight bars.

4. The weight spacer apparatus of claim 2, wherein it further comprises a detonating cord disclosed in the second compartment of the divided spacer tube.

5. The weight spacer apparatus of claim 2, wherein the spacer tube has openings formed in the portion opposite the first compartment for receiving shaped charges.

6. The weight spacer apparatus of claim 5, further comprising a shaped charge which is installed in each of said openings in the spacer tube.

7. The weight spacer apparatus of claim 6, wherein it further comprises a detonating cord disposed in the second compartment of the spacer tube for connecting to the shaped charges.

8. A perforating string, comprising:

at least one perforating gun section; and a weight spacer comprising:

a carrier which is tubular in shape;

a spacer tube which is tubular in shape and which is located inside the carrier; and a plurality of weight bars located in the spacer tube and which may be placed in the spacer tube after the spacer tube is inserted in the carrier and which are removable from the spacer tube;

wherein the spacer tube comprises a weight tray for receiving the weight bars, the weight tray comprising a half-round tubing material and a late covering a diametric opening of the half-round tubing material, the half-round tubing material and the plate together forming a longitudinally extending enclosure having an opening at each end, and an end plate covering at least a portion of one of the openings.

9. A perforating string, comprising:

at least one perforating gun section; and a weight spacer comprising:

a carrier which is tubular in shape;

a spacer tube which is tubular in shape and which is for insertion into the carrier; and a plurality of weight bars which may be placed in the spacer tube after the spacer tube is inserted in the carrier and which are removable from the spacer tube;

wherein the weight spacer comprises a center plate which is attached inside the spacer tube along the length of the spacer tube to divide the spacer tube into first and second compartments.

10. The perforating string of claim 9, wherein the first compartment of the divided spacer tube is for receiving the plurality of weight bars.

11. The perforating string of claim 9, wherein the spacer tube has openings formed therein in the portion opposite the first compartment for receiving shaped charges.

12. The perforating string of claim 11, further comprising a shaped charge installed in each of the openings in the spacer tube.

13. The perforating string of claim 12, further comprising a detonating cord disposed in the second compartment of the spacer tube for connecting the shaped charges into the ballistic train of the perforating string.

14. A method of forming a weight spacer assembly for use in a perforating string, comprising:

inserting a spacer tube into a tubular carrier, said spacer tube including a weight tray; and inserting weight bars into the weight tray after the spacer tube has been inserted into the carrier.

15. The method of claim 14, wherein it further comprises the step of:

installing shaped charges in the spacer tube before the spacer tube is inserted into the carrier.

* * * * *